United States Patent [19]

Diery et al.

[11] 4,297,236

[45] Oct. 27, 1981

[54] WATER MISCIBLE CORROSION INHIBITORS

[75] Inventors: Helmut Diery, Kelkheim; Rainer Helwerth, Eschborn; Horst Fröhlich, Eppstein; Horst Lorke, Liederbach, all of Fed. Rep. of Germany

[73] Assignee: Hoechst Aktiengesellschaft, Fed. Rep. of Germany

[21] Appl. No.: 942,337

[22] Filed: Sep. 14, 1978

[30] Foreign Application Priority Data

Sep. 19, 1977 [CH] Switzerland ..... 11419/77

[51] Int. Cl.[3] ..... C23F 11/14; C23F 11/16; C23F 11/18

[52] U.S. Cl. ..... 252/389 R; 252/8.55 E; 252/68; 252/77; 252/79; 252/391; 106/14.14; 106/14.16; 106/14.17; 106/14.18; 422/12; 422/16; 422/17

[58] Field of Search ..... 252/389 R, 391, 8.55 E, 252/68, 77, 79; 422/12, 16, 17; 106/14.14, 14.15, 14.16, 14.17, 14.18

[56] References Cited

U.S. PATENT DOCUMENTS

| | | | |
|---|---|---|---|
| 3,642,652 | 2/1972 | Birgy | 252/389 R |
| 3,755,176 | 8/1973 | Kinney et al. | 252/391 |
| 3,992,306 | 11/1976 | Diery et al. | 252/391 |
| 4,060,522 | 11/1977 | Kindscher et al. | 252/391 |
| 4,144,188 | 3/1979 | Sato | 252/389 R |

FOREIGN PATENT DOCUMENTS

| | | | |
|---|---|---|---|
| 1298672 | 7/1969 | Fed. Rep. of Germany | 252/391 |
| 1620447 | 4/1970 | Fed. Rep. of Germany . | |
| 1771548 | 12/1971 | Fed. Rep. of Germany . | |

*Primary Examiner*—Richard E. Schafer
*Assistant Examiner*—Irwin Gluck
*Attorney, Agent, or Firm*—Connolly and Hutz

[57] ABSTRACT

Water-miscible corrosion inhibitors, substantially consisting of (A) reaction products of boric acid and diethanolamine, and (B) arylsulfonamidocarboxylic acids of the formula I

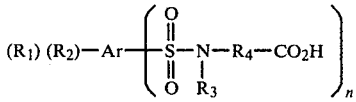

in which $R_1$ and $R_2$ each represent hydrogen, fluorine, chlorine, bromine, an alkyl or alkoxy radical having from 1 to 4 carbon atoms, with the proviso that the sum of the carbon atoms of $R_1$ and $R_2$ does not exceed 7;

Ar is a benzene, naphthalene or anthracene radical;

$R_3$ is hydrogen, an aryl radical having up to 4 carbon atoms, a $\beta$-cyanoethyl or hydroxyalkyl radical having from 2 to 4 carbon atoms;

$R_4$ is an alkylene radical having more than 3 carbon atoms, optionally substituted by one or more methyl or ethyl radicals; and n is 1 or 2; or alkyl- and/or cycloalkylsulfonamidocarboxylic acids obtained by sulfochlorination of a saturated aliphatic and/or cycloaliphatic hydrocarbon having from 12 to 22 carbon atoms and a boiling temperature range of from about 200° to 350° C., subsequent reaction with ammonia and final condensation with chloroacetic acid.

3 Claims, No Drawings

WATER MISCIBLE CORROSION INHIBITORS

This invention relates to water-miscible corrosion inhibitors for ferrous metals, for use in drilling, cutting or laminating liquids, or for circulation cooling systems and hydraulic liquids.

It is known that salts of long-chain alkylsulfonamidocarboxylic acids have a corrosion-inhibiting effect and are therefore used in metal processing. Compounds of this type, which are described in German Pat. No. 900,041, are generally obtained in admixture with the starting hydrocarbon because of their preparation method, and they are mainly applied in the form of aqueous emulsions, optionally with addition of mineral oils. For reasons of the sensitivity of such emulsions to foreign salts, elevated temperature and germ infection, oil-free metal processing agents have been developed such as they are described in German Pat. No. 1,298,672 and German Offenlegungsschrift No. 1,771,548. However, these water-soluble metal processing agents, although being free from the drawbacks of the emulsions, display an insufficient activity especially in hard water; precipitation of calcium salts provokes formation of sticky deposits on the machines and results in depletion of active substance in the solution.

For improving the corrosion-proofing effect, sodium nitrite has often been added to the metal processing liquids. However, because of the acute toxicity for man and the risk of formation of the cancerogenic nitrosamines from nitrite and the amines contained in many corrosion inhibitors, further use of such additives would be irresponsible.

It is also known that mixtures of boric acid and alkanolamines, to which unsaturated fatty acids having from 18 to 22 carbon atoms are optionally added, yield water-soluble cutting liquids. However, apart from an insufficient corrosion-inhibiting effect, these liquids have the disadvantageous property of foaming (see U.S. Pat. No. 2,999,064).

Furthermore, it is known that piperazine derivatives formed in a condensation reaction at elevated temperature from amino-alcohols, boric acid and carboxylic acids, are used as corrosion inhibitor, cooling, lubricating and cutting agent (German Pat. No. 1,620,447). However, their corrosion-inhibiting action is not superior to that of the hitherto known products.

Improvements of the protection against corrosion, especially in the case of water-soluble metal processing agents, is of great importance, because this would allow to reduce the amounts of such agents, which is desirable for easing the problems of waste removal, for instance.

It has now been found that, surprisingly, mixtures of certain aryl- or alkylsulfonamidocarboxylic acids and reaction products of boric acid and diethanolamine have an especially good corrosion-inhibiting action, which exceeds that of the addition effect of the individual components.

Subject of this invention are corrosion inhibitors for ferrous metals, substantially consisting of (A) reaction products of boric acid and diethanolamine, and (B) arylsulfonamidocarboxylic acids of the formula I

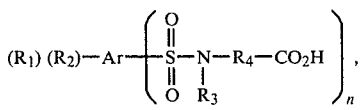

I in which $R_1$ and $R_2$ each represent hydrogen, fluorine, chlorine, bromine, an alkyl or alkoxy radical having from 1 to 4 carbon atoms, with the proviso that the sum of the carbon atoms of $R_1$ and $R_2$ does not exceed 7;

Ar is a benzene, naphthalene or anthracene radical;

$R_3$ is hydrogen, an aryl radical having up to 4 carbon atoms, a β-cyanoethyl or hydroxyalkyl radical having from 2 to 4 carbon atoms;

$R_4$ is an alkylene radical having more than 3 carbon atoms, optionally substituted by one or more methyl or ethyl radicals; and n is 1 or 2; or alkyl- and/or cycloalkylsulfonamidocarboxylic acids obtained by sulfochlorination of a saturated aliphatic and/or cycloaliphatic hydrocarbon having from 12 to 22 carbon atoms and a boiling temperature range of from about 200° to 350° C., subsequent reaction with ammonia and final condensation with chloroacetic acid.

The invention relates furthermore to the use of the above corrosion inhibitors in the form of aqueous formulations as essential component of aqueous drilling, cutting or laminating liquids, or as corrosion-inhibiting additives for aqueous circulation cooling systems or power water.

The reaction products of boric acid and diethanolamine can be prepared according to known methods by mixing 1 mol of boric acid or boron trioxide with about 1 to 4 mols of diethanolamine. Although the reaction proceeds at room temperature already, it is advantageous to carry it out at elevated temperature of up to about 175° C. in order to accelerate it. During this reaction, water is split off partially and high molecular weight estes are formed in an equilibrium reaction. When the reaction product is used in aqueous phase, the equilibrium is partially shifted by splitting off the ester due to hydrolysis. In the reaction, the molar ratio of boric acid to diethanolamine may vary from 1:1 to 1:4 without adversely affecting the activity of the product; preferably, however, an excess of diethanolamine exceeding the equimolar ratio of 1:1.5 is used, and this excess should be advantageously at least sufficient to neutralize the sulfonamidocarboxylic acid, that is, the second component of the corrosion inhibitor according to this invention.

The arylsulfonamidocarboxylic acids of the formula I and processes for preparing them are describes in German Pat. No. 1,298,672. Especially suitable for the corrosion inhibitor of this invention are arylsulfonamidocarboxylic acids of the formula II

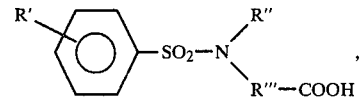

II in which R′ is hydrogen, methyl or ethyl, R″ is hydrogen, methyl, ethyl, a β-cyanoethyl or hydroxymethyl radical, and R‴ is an alkylene radical having from 4 to 6 carbon atoms. Preferred examples of such arylsulfonamidocarboxylic acids are ϵ-[benzenesulfonyl-N-methylamino]-n-capronic acid and ϵ-[toluenesulfonyl-N-methylamino]-n-capronic acid.

The alkyl- or cycloalkylsulfonamidocarboxylic acids which may be used are substantially those of the formula III

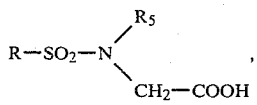

III in which R is saturated aliphatic or cycloaliphatic hydrocarbon radical having from 12 to 22 carbon atoms, and $R_5$ is hydrogen or the —$CH_2$—COOH radical. The preparation of these alkyl- or cycloalkylsulfonamidocarboxylic acids is described for example in German Pat. No. 900,041; it is carried out by sulfochlorination of saturated hydrocarbons having from 12 to 22 carbon atoms and a boiling temperature range of from 200° to 350° C., which consist substantially of n-paraffins but may contain also branched and/or cyclic portions, subsequent reaction with ammonia and final condensation with chloroacetic acid. Because of the incomplete sulfochlorination, these products still contain a certain amount of unreacted paraffin and/or chloroparaffin; generally, their acid number is in the range of from about 40 to 60.

The corrosion inhibitors of the invention are prepared by simply mixing the components at room temperature or slightly elevated temperatures of up to about 100° C. In general, they consist preponderantly of the reaction products of boric acid and diethanolamine, while the amount of component (B), that is, the aryl- or alkylsulfonamidocarboxylic acids, in the corrosion inhibitors is normally from about 10 to 50, preferably 10 to 30, % by weight. These indications relate to the pure acids, even when using the alkyl- or cycloalkylsulfonamidocarboxylic acids, because the amount of unreacted hydrocarbons or chloroparaffin accompanying these sulfonamidocarboxylic acids is eliminated by phase separation after the mixture with the reaction products of boric acid and diethanolamine is complete. In order to accelerate the phase separation, the mixture is allowed to settle advantageously at slightly elevated temperature, preferably at 50° to 70° C.

The corrosion inhibitors of the invention are transparently water-soluble or easily emulsifiable products which are generally present in the form of viscous liquids. They can be applied with special advantage as corrosion-inhibiting component of aqueous cooling formulations, especially drilling, cutting or laminating liquids, furthermore of circulation cooling systems and power water. For preparing the aqueous cooling formulations, the corresponding inhibitors are stirred into the required amount of water. The concentration of application of the novel corrosion inhibitors is generally from 0.5 to 10, preferably 2 to 5, % by weight. If necessary, further substances known for such application may be added to the aqueous cooling formulations. These aqueous cooling formulations containing the corrosion inhibitors of the invention are transparently aqueous solutions to emulsion-like liquids poor in foam, which are distinguished by a good corrosion-inhibiting action even when using hard water, and by good preserving properties at high resistance to the hardening substances of the water.

The following examples which describe the preparation of the corrosion inhibitors illustrate the invention.

EXAMPLE 1

315 g (3 mols) diethanolamine and 61.8 g (1 mol) pulverulent boric acid are mixed at room temperature and stirred at this temperature until a transparent yellow viscous liquid has formed, that is, for about 8 hours.

40 g ϵ-[benzenesulfonyl-methylamino]-n-capronic acid are added to 160 g of the product so obtained, and the mixture is stirred until a transparent yellow viscous liquid has formed which can be used as corrosion inhibitor for aqueous liquids.

EXAMPLE 2

315 g (3 mols) diethanolamine are heated to 100° C., and 61.8 g (1 mol) boric acid are added; after 10 to 20 minutes, a clear yellow liquid is obtained.

40 g ϵ-[benzenesulfonyl-methylamino]-n-capronic acid are added at 60° C. with agitation to 160 g of the above liquid.

The transparent viscous liquid so obtained can be used as corrosion inhibitor.

EXAMPLE 3

(a) 315 g (3 mols) diethanolamine are heated to 100° C., and 61.8 g (1 mol) boric acid are added, the temperature is raised to 175° C. within 1 hour, and about 50 ml water are distilled off in a descending condenser. A clear yellow liquid is obtained which is highly viscous at room temperature.

(b) 160 g of this liquid are mixed at 60° C. with agitation with 40 g ϵ-[benzenesulfonyl-methylamino]-n-capronic acid.

(c) 66 g of a paraffin oil-containing alkylsulfonamidoacetic acid, prepared according to German Pat. No. 900,041, Example 1, starting however from a hydrocarbon mixture containing branched, linear and cyclic paraffins having from 12 to 22 carbon atoms, a boiling temperature range of from 244° to 332° C. and a refractive index $n_D^{20}$ of 1.445, are added at 60° C. and with agitation to 160 g of the liquid obtained according to (a). The oily phase (26 g) separated after a 90 minutes standing is removed from the mixture obtained.

(d) 33 g of the alkylsulfonamido-acetic acid according to (c) are added to 180 g of the liquid obtained according to (a), and the oily phase (13 g) is removed at 60° C.

(e) 60 g ϵ-[benzenesulfonyl-methylamino]-n-capronic acid are added at 60° C. and with agitation to 140 g of the liquid obtained according to (a).

(f) 100 g of the alkylsulfonamido-acetic acid according to (c) are added to 140 g of the liquid obtained according to (a), and the oily phase (40 g) is removed at 60° C.

(g) 66 g of an alkylsulfonamido-acetic acid prepared according to German Pat. No. 900,041, Example 1, starting however from a hydrocarbon consisting of linear paraffins having from 14 to 17 carbon atoms, a boiling temperature range of from 237° to 288° C. and a refractive index $n_D^{20}$ of 1.432, are added at 60° C. to 160 g of the liquid obtained according to (a). The oily phase (26 g) separated from the mixture at 60° C. within 90 minutes is removed.

40 g each of the arylsulfonamidocarboxylic acids cited as follows sub (h) to (n) are added at 60° C. and with agitation to 160 g each of the liquid obtained according to (a): (h) ϵ-[benzenesulfonyl-N-hydroxymethyl-amino]-n-capronic acid (i) ϵ-[benzenesulfonyl-N-β-cyanoethyl-amino]-n-capronic acid (k) ϵ-[acetylbenzenesulfonyl-N-methyl-amino]-n-capronic acid (l) ϵ-[benzenesulfonyl-N-ethyl-amino]-n-capronic acid (m) ϵ-[toluenesulfonyl-N-methyl-amino]-n-capronic acid (n) ϵ-[benzenesulfonyl-amino]-n-capronic acid.

The products so obtained were used for the corrosion tests described further below and examined together with comparative substances.

EXAMPLE 4

(a) 61.8 g (1 mol) boric acid are introduced at 100° C. and with agitation into 420 g (4 mols) diethanolamine, and the subsequent operations are as described in Example 3(a). A transparent yellowish liquid is obtained.

(b) 40 g ϵ-[benzenesulfonyl-methylamino]-n-capronic acid are stirred at 60° C. into 160 g of the product obtained according to (a).

(c) 66 g of a paraffin-oil containing alkylsulfonamidoacetic acid, prepared according to German Pat. No. 900,041, Example 1, starting however from a hydrocarbon mixture containing branched, linear and cyclic paraffins having from 12 to 22 carbon atoms, a boiling temperature range of from 244° to 332° C. and a refractive index $n_D^{20}$ of 1.445, are added at 60° C. and with agitation to 160 g of the liquid obtained according to (a). The oily phase (26 g) separated after a 90 minutes standing at 60° C. is removed from the mixture.

EXAMPLE 5

(a) 61.8 g (1 mol) boric acid are added at 100° C. and with agitation to 210 g (2 mols) of diethanolamine; subsequently, work-up is continued as described in Example 3(a). A transparent yellow liquid is obtained.

(b) 40 g ϵ-[benzenesulfonyl-methylamino]-n-capronic acid are stirred at 60° C. into 160 g of the liquid obtained according to (a).

(c) 66 g of a paraffin-oil containing alkylsulfonamidoacetic acid, prepared according to German Pat. No. 900,041, Example 1, starting however from a hydrocarbon mixture containing branched, linear and cyclic paraffins having from 12 to 22 carbon atoms, a boiling temperature range of from 244° to 332° C. and a refractive index $n_D^{20}$ of 1.445, are added at 60° C. and with agitation to 160 g of the liquid obtained according to (a). The oily phase (26 g) separated after a 90 minutes standing at 60° C. is removed from the mixture.

The corrosion-inhibiting activity of the products obtained in the above Examples was tested and evaluated together with comparative substances. For the tests, aqueous formulations having a content of 1.0, 1.5, 2.0 and 3.0% of active substance were used. For a comparison, the following products were employed:

Comparative product A

ϵ-[benzenesulfonyl-methylamino]-n-capronic acid 35%, triethanolamine 50%, water 15% (when adjusting the dilutions of the product, the amount of water was taken into consideration).

Comparative product B

Alkylsulfonamido-acetic acid according to Example 3(c), in the form of sodium salt.

Comparative product C

Piperazine derivative, prepared by condensation of diethanolamine with boric and oleic acid according to German Auslegeschrift No. 1,620,447, Example 6.

The test results are listed in the following Table:

TABLE

| Active substance | corrosion degree acc. to DIN 51360, Sheet 2 | | | |
|---|---|---|---|---|
| concentration | 1.0% | 1.5% | 2.0% | 3.0% |
| Comparative Product A | 4 | 2–3 | 1–2 | 0 |
| Comparative Product B | 4 | 4 | 4 | 3 |
| Comparative Product C | 4 | 3–4 | 2 | 1 |
| Example 1 | 4 | 2 | 0 | 0 |
| Example 2 | 3–4 | 1–2 | 0 | 0 |
| Example 3 a (Comp.) | 4 | 4 | 3 | 2 |
| Example 3 b | 1–2 | 1 | 0 | 0 |
| Example 3 c | 3 | 2–3 | 1 | 0 |
| Example 3 d | 4 | 2 | 1 | 0 |
| Example 3 e | 4 | 1 | 0 | 0 |
| Example 3 f | 4 | 1 | 0 | 0 |
| Example 3 g | 3 | 2 | 0 | 0 |
| Example 3 h | 4 | 2–3 | 0 | 0 |
| Example 3 i | 3 | 0 | 0 | 0 |
| Example 3 k | 3 | 0 | 0 | 0 |
| Example 3 l | 3 | 0 | 0 | 0 |
| Example 3 m | 2 | 0 | 0 | 0 |
| Example 3 n | 4 | 1 | 0 | 0 |
| Example 4 a (Comp.) | 4 | 3 | 3 | 2 |
| Example 4 b | 3 | 2 | 0 | 0 |
| Example 4 c | 2–3 | 2 | 0 | 0 |
| Example 5 a (Comp.) | 3–4 | 3 | 2–3 | 2 |
| Example 5 b | 4 | 1 | 0 | 0 |
| Example 5 c | 3 | 2 | 0 | 0 |

What is claimed is:

1. Corrosion inhibitors consisting essentially of a mixture of (A) reaction products of boric acid and diethanolamine, and (B) arylsulfonamidocarboxylic acids of the formula I

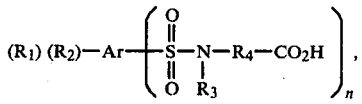

I in which $R_1$ and $R_2$ each represent hydrogen, fluorine, chlorine, bromine, an alkyl or alkoxy radical having from 1 to 4 carbon atoms, with the proviso that the sum of the carbon atoms of $R_1$ and $R_2$ does not exceed 7;

Ar is a benzene, naphthalene or anthracene radical;

$R_3$ is hydrogen, an aryl radical having up to 4 carbon atoms, a β-cyanoethyl or hydroxyalkyl radical having from 2 to 4 carbon atoms;

$R_4$ is an alkylene radical having more than 3 carbon atoms, optionally substituted by one or more methyl or ethyl radicals; and n is 1 or 2; or alkyl- and/or cycloalkylsulfonamidocarboxylic acids obtained by sulfochlorination of a saturated aliphatic and/or cycloaliphatic hydrocarbon having from 12 to 22 carbon atoms and a boiling temperature range of from about 200° to 350° C., subsequent reaction with ammonia and final condensation with chloroacetic acid.

2. Corrosion inhibitors as claimed in claim 1 consisting of a mixture of (A) reaction products of boric acid and diethanolamine, and (B) arylsulfonamidocarboxylic acids of the formula II

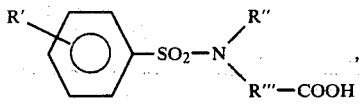

II in which R′ is $C_2H_5$, $CH_3$ or H, R″ is $CH_2$—$CH_2$—CN, $C_2H_5$, $CH_3$, $CH_2OH$ or H, and R‴ is an alkylene radical having from 4 to 6 carbon atoms.

3. A process for inhibiting the corrosion of ferrous metals on contact with water or aqueous liquids, which comprises adding to the water or the aqueous liquids from 0.5 to 10% by weight of a mixture of (A) reaction products of boric acid and diethanolamine, and (B) arylsulfonamidocarboxylic acids of the formula I

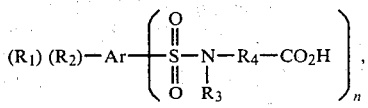

I in which $R_1$ and $R_2$ each represent hydrogen, fluorine, chlorine, bromine, an alkyl or alkoxy radical having from 1 to 4 carbon atoms, with the proviso that the sum of the carbon atoms of $R_1$ and $R_2$ does not exceed 7;

Ar is a benzene, naphthalene or anthraceno radical;

$R_3$ is hydrogen, an aryl radical having up to 4 carbon atoms, a β-cyanoethyl or hydroxyalkyl radical having from 2 to 4 carbon atoms;

$R_4$ is an alkylene radical having more than 3 carbon atoms, optionally substituted by one or more methyl or ethyl radicals; and n is 1 or 2; or alkyl- and/or cycloalkylsulfonamidocarboxylic acids obtained by sulfochlorination of a saturated aliphatic and/or cycloaliphatic hydrocarbon having from 12 to 22 carbon atoms and a boiling temperature range of from about 200° to 350° C., subsequent reaction with ammonia and final condensation with chloroacetic acid.

* * * * *